US009626896B2

(12) United States Patent
Lee et al.

(10) Patent No.: US 9,626,896 B2
(45) Date of Patent: Apr. 18, 2017

(54) DISPLAY DEVICE AND MOBILE ELECTRONIC APPARATUS INCLUDING THE SAME

(71) Applicant: SAMSUNG ELECTRONICS CO., LTD., Suwon-si, Gyeonggi-do (KR)

(72) Inventors: Seung-Gun Lee, Hwaseong-si (KR); Hyo-Jin Kim, Hwaseong-si (KR); Hak-Seong Lee, Hwaseong-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 19 days.

(21) Appl. No.: 14/615,097

(22) Filed: Feb. 5, 2015

(65) Prior Publication Data

US 2015/0325213 A1 Nov. 12, 2015

(30) Foreign Application Priority Data

May 7, 2014 (KR) ..... 10-2014-0053899

(51) Int. Cl.

| | |
|---|---|
| ***G09G 5/00*** | (2006.01) |
| ***G09G 3/20*** | (2006.01) |
| ***G09G 5/18*** | (2006.01) |
| ***G09G 3/3208*** | (2016.01) |

(52) U.S. Cl.

CPC ..... *G09G 3/2096* (2013.01); *G09G 3/3208* (2013.01); *G09G 5/008* (2013.01); *G09G 5/18* (2013.01); *G09G 2300/0426* (2013.01); *G09G 2310/0243* (2013.01); *G09G 2370/10* (2013.01)

(58) Field of Classification Search

None

See application file for complete search history.

(56) References Cited

U.S. PATENT DOCUMENTS

| | | | | |
|---|---|---|---|---|
| 4,415,985 | A * | 11/1983 | McDaniel | G05B 19/409 345/501 |
| 6,229,765 | B1 | 5/2001 | Rabi | |
| 6,393,263 | B1 | 5/2002 | Hayashi | |
| 6,747,916 | B1 | 6/2004 | Fleury et al. | |
| 6,876,600 | B2 | 4/2005 | Ito et al. | |
| 7,181,006 | B2 | 2/2007 | Shimazaki | |
| 8,547,800 | B2 | 10/2013 | Kiyomizu | |
| 2003/0051211 | A1* | 3/2003 | Fujisaki | G06Q 10/107 715/255 |

(Continued)

FOREIGN PATENT DOCUMENTS

| | | |
|---|---|---|
| KR | 1020050001526 | 1/2005 |
| KR | 1020110051897 | 5/2011 |

*Primary Examiner* — Andrew Sasinowski
*Assistant Examiner* — Henok Heyi
(74) *Attorney, Agent, or Firm* — F. Chau & Associates, LLC

(57) ABSTRACT

A mobile device includes a display driver integrated circuit (DDI), a display panel, and an application processor. The DDI provides an internal synchronization signal based on an internal clock signal as a synchronization signal. The application processor calculates a time offset corresponding to a difference between a real time and the internal synchronization signal, and provides the time offset to the DDI. The DDI calculates a time to be displayed based on the time offset and a current time provided from the application processor, and displays the time to be displayed in the display panel in a self clock display mode.

21 Claims, 14 Drawing Sheets

(56) References Cited

U.S. PATENT DOCUMENTS

| | | | | |
|---|---|---|---|---|
| 2005/0111304 | A1* | 5/2005 | Pikula | G04G 3/00 368/47 |
| 2011/0254829 | A1 | 10/2011 | Agevik et al. | |
| 2011/0285833 | A1* | 11/2011 | Tsurumoto | G09G 3/003 348/56 |
| 2012/0155584 | A1* | 6/2012 | Wilkinson | G04G 7/00 375/354 |
| 2012/0287325 | A1* | 11/2012 | Oikawa | H04N 5/772 348/333.02 |
| 2013/0082615 | A1* | 4/2013 | Williams | H05B 33/0827 315/186 |
| 2013/0142300 | A1* | 6/2013 | Takemura | G04F 1/005 377/20 |
| 2013/0314360 | A1* | 11/2013 | Saitoh | G06F 3/0412 345/173 |
| 2015/0033060 | A1* | 1/2015 | Kim | G06F 1/12 713/400 |

* cited by examiner

DISPLAY DEVICE AND MOBILE ELECTRONIC APPARATUS INCLUDING THE SAME

CROSS-REFERENCE TO RELATED APPLICATION

This application claims priority under 35 U.S.C. §119 to Korean Patent Application No. 10-2014-0053899, filed on May 7, 2014, in the Korean Intellectual Property Office, the disclosure of which is incorporated by reference herein in its entirety.

TECHNICAL FIELD

Exemplary embodiments of the present inventive concept relate to a display device, and more particularly to, a mobile electronic apparatus including the display device.

DISCUSSION OF THE RELATED ART

Some smart phones have a display device capable of displaying high-definition television (HDTV) signals. The smart phone may include a display driver integrated circuit (IC) for managing the HDTV signals to the display device. For example, the display device may be an organic light-emitting display (OLED).

In addition, the smart phones can be configured to connect to wearable devices.

SUMMARY

According to an exemplary embodiment of the present inventive concept, a mobile device includes a display driver integrated circuit (DDI), a display panel, and an application processor. The DDI provides an internal synchronization signal based on an internal clock signal as a synchronization signal. The application processor calculates a time offset corresponding to a difference between a real time and the internal synchronization signal, and provides the time offset to the DDI. The DDI calculates a time to be displayed based on the time offset and a current time provided from the application processor, and displays the time to be displayed in the display panel in a self clock display mode.

In an exemplary embodiment, the DDI may include an oscillator, an internal synchronization signal generator, and a timer logic circuit. The oscillator may generate the internal clock signal. The internal synchronization signal generator may generate an internal horizontal synchronization signal and an internal vertical synchronization signal based on the internal clock signal. The timer logic circuit may generate digital time information corresponding to the time to be displayed based on the time offset, the internal clock signal, and the current time.

In an exemplary embodiment, the DDI may further include an interface that provides the application processor with one of the internal horizontal synchronization signal and the internal vertical synchronization signal as the synchronization signal.

In an exemplary embodiment, the timer logic circuit may include a register and an internal timer. The register may store the time offset. The internal timer may output the digital time information based on the internal clock signal, the current time, and the time offset stored in the register.

In an exemplary embodiment, the internal timer may include a counter and a time adjuster. The counter may count the internal clock signal, and may output a counting value.

The time adjuster may receive the current time and the time offset, may adjust the current time based on the counting value and the time offset, and may provide the digital time information.

In an exemplary embodiment, the DDI may further include a symbol memory and a control logic circuit. The symbol memory may store a plurality of timing symbols that are used for displaying the time to be displayed. The control logic circuit may control the symbol memory such that, among the plurality of timing symbols, timing symbols associated with the time to be displayed may be output.

In an exemplary embodiment, the DDI may further include a selection circuit. The selection circuit may select one of an image signal and the time to be displayed, and may provide the selected one of the image signal and the time to be displayed to a timing controller in response to a mode change signal. The mode change signal may be one of the self clock display mode and a video mode. The image signal provided from the application processor may be displayed in the video mode.

In an exemplary embodiment, the application processor may include an offset calculator and a real time generator. The offset calculator may calculate the real time and the time offset based on the synchronization signal. The real time generator may generate the real time.

In an exemplary embodiment, the application processor may be connected to the DDI through a high speed serial interface (HSSI). The application processor may enter into a sleep mode in the self clock display mode. The display device may include a watch-typed wearable device.

According to an exemplary embodiment of the present inventive concept, a mobile device includes an application processor, a display panel, and a display driver integrated circuit (DDI). The application processor provides a current time indicating a real time in response to an interrupt signal that is periodically received. The DDI provides an internal synchronization signal based on an internal clock signal, adjusts a period of the interrupt signal that is provided to the application processor based on time offsets, and calculates a time to be displayed based on the current time. Further, the DDI displays the time to be displayed in the display panel. Each of the time offsets corresponds to a difference between the current time and the internal synchronization signal.

In an exemplary embodiment, the DDI may include an oscillator, an internal synchronization signal generator, and a timer logic circuit. The oscillator may generate the internal clock signal. The internal synchronization signal generator may generate an internal horizontal synchronization signal and an internal vertical synchronization signal based on the internal clock signal. The timer logic circuit may generate digital time information corresponding to the time to be displayed based on an internal synchronization signal, the internal clock signal, and the current time. The internal synchronization signal may be one of the internal horizontal synchronization signal and the internal vertical synchronization signal.

In an exemplary embodiment, the timer logic circuit may include a register, a comparator, and an interrupt signal generator. The register may store the time offsets. The comparator may calculate a difference between two consecutive time offsets among the time offsets, and may output a digital code corresponding to the difference between the two consecutive time offsets. The interrupt signal generator may adjust an activation period of the interrupt signal, in response to the digital code.

In an exemplary embodiment, the interrupt signal generator may increase the activation period of the interrupt signal in response to the digital code when there is no difference between the two consecutive time offsets.

In an exemplary embodiment, the interrupt signal generator may maintain the activation period of the interrupt signal in response to the digital code when there is a difference between the two consecutive time offsets.

In an exemplary embodiment, the DDI may further include a temperature sensor. The temperature sensor may sense an operating temperature of the DDI. The temperature sensor may provide the interrupt signal generator with a temperature signal that is activated when the sensed operating temperature is out of a reference time range. The interrupt signal generator may provide the interrupt signal to the application processor in response to the temperature signal.

In an exemplary embodiment, the application processor may enter into a sleep mode after the application processor transmits the current time to the DDI in response to the interrupt signal.

According to an exemplary embodiment, a mobile electronic apparatus includes a mobile device and a display device. The display device operates in cooperation with the mobile device. The display device includes an application processor and a display driver integrated circuit (DDI). The application processer includes a real time generator that generates a real time. The DDI is connected to the application processor through a high speed serial interface (HSSI). The DDI provides an internal synchronization signal based on an internal clock signal. The DDI calculates a time to be displayed based on a time offset corresponding to a difference between a current time provided from the application processor and the internal synchronization signal, and displays the time to be displayed in a display panel in a self clock display mode.

In an exemplary embodiment, the mobile device may include a smart phone, and the display device may include a watch-typed wearable device.

In an exemplary embodiment, the DDI may include may include an oscillator, an internal synchronization signal generator, and a timer logic circuit. The oscillator may generate the internal clock signal. The internal synchronization signal generator may generate an internal horizontal synchronization signal and an internal vertical synchronization signal based on the internal clock signal. The timer logic circuit may generate digital time information corresponding to the time to be displayed based on the time offset, the internal clock signal and the current time.

In an exemplary embodiment, the DDI may include an oscillator, an internal synchronization signal generator, and a timer logic. The oscillator may generate the internal clock signal. The internal synchronization signal generator may generate an internal horizontal synchronization signal and an internal vertical synchronization signal based on the internal clock signal. The timer logic may generate digital time information corresponding to the time to be displayed based on an internal synchronization signal, the internal clock signal and the current time. The internal synchronization signal may be one of the internal horizontal synchronization signal and the internal vertical synchronization signal.

Accordingly, the DDI may reduce power consumption by cutting off interfacing with the application processor in the self clock display mode because the DDI calculates for itself the time to be displayed based on the current time and the time offset corresponding to a difference between a real time and an internal clock signal and displays the time to be displayed in a display panel in the self clock display mode.

BRIEF DESCRIPTION OF THE DRAWINGS

Illustrative, non-limiting exemplary embodiment of the present inventive concept will be more clearly understood from the following detailed description taken in conjunction with the accompanying drawings.

DETAILED DESCRIPTION OF THE EMBODIMENTS

Figure 1:
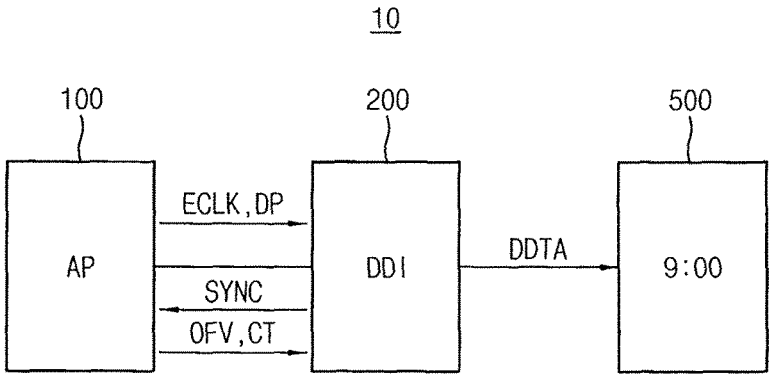
FIG. 1 is a block diagram illustrating an example of a display device according to an exemplary embodiment of the present inventive concept.

Various exemplary embodiments of the present inventive concept will be described more fully hereinafter with reference to the accompanying drawings, in which exemplary embodiments thereof are shown. The present inventive concept may, however, be embodied in many different forms and should not be construed as limited to the exemplary embodiments set forth herein. These exemplary embodiments of the present inventive concept are just that—examples—and many implementations and variations are possible that do not require the details provided herein. It should also be emphasized that the present inventive concept provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the present inventive concept. Like numerals may refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating an example of a display device according to an exemplary embodiment of the present inventive concept.

Referring to FIG. 1, a display device 10 may include an application processor 100, a display driver integrated circuit (DDI) 200, and a display panel 500.

The application processor 100 may control an overall operation of the display device 10. The application processor 100 may provide the DDI 200 with a data packet DP including image data in response to a clock signal ECLK. The data packet DP may include the image data, a horizontal synchronization signal, a vertical synchronization signal, and a data enable signal.

In addition, the application processor 100 may provide the DDI 200 with a time offset OFV and a current time CT that indicates a real time in response to a synchronization signal SYNC provided from the DDI 200. The time offset OFV may correspond to a difference between the real time and an internal clock signal that is internally generated in the DDI 200. The DDI 200 may include an RC oscillator that generates the internal clock signal. The internal clock signal may have an error with respect to the real time, and the error may correspond to the time offset OFV.

The DDI 200, in a video mode, may process the image data in the data packet DP and may output a display data DDTA to the display panel 500. In addition, the DDI 200, in a self clock display mode, may calculate internally a time to be displayed based on the time offset OFV and the current time CT and may output the time to be displayed to the display panel 500 as the display data DDTA. For example, the DDI 200, in the self clock display mode, may reduce power consumption by calculating internally the time to be displayed and outputting the time to be displayed to the display panel 500 as the display data DDTA without interfacing with the application processor 100.

In an exemplary embodiment, the application processor 100 and the DDI 200 may provide an interface such as a mobile industry processor interface (MIPI), a mobile display digital interface (MDDI), a compact display port (CDP), or the like. In an exemplary embodiment, the DDI 200 may include a graphic memory for a high speed serial interface. Without the graphic memory, the DDI 200 may consume more power and may produce more heat. Further, the load on the application processor 100 may be reduced when the graphic memory is included within the DDI 200. Display data that is input from the application processor 100 may be written into the graphic memory, and data stored in the graphic memory may be output through a scan operation. In an exemplary embodiment, the graphic memory may be a dual port dynamic random access memory (DRAM).

The display panel 500 may display the display data DDTA in units of frames according to a control of the DDI 200. The display panel 500 may be one of an organic light-emitting display (OLED) panel, a liquid crystal display (LCD) panel, a plasma display panel (PDP), an electrophoretic display panel, and an electrowetting display panel. However, the present inventive concept is not limited thereto.

Figure 2:
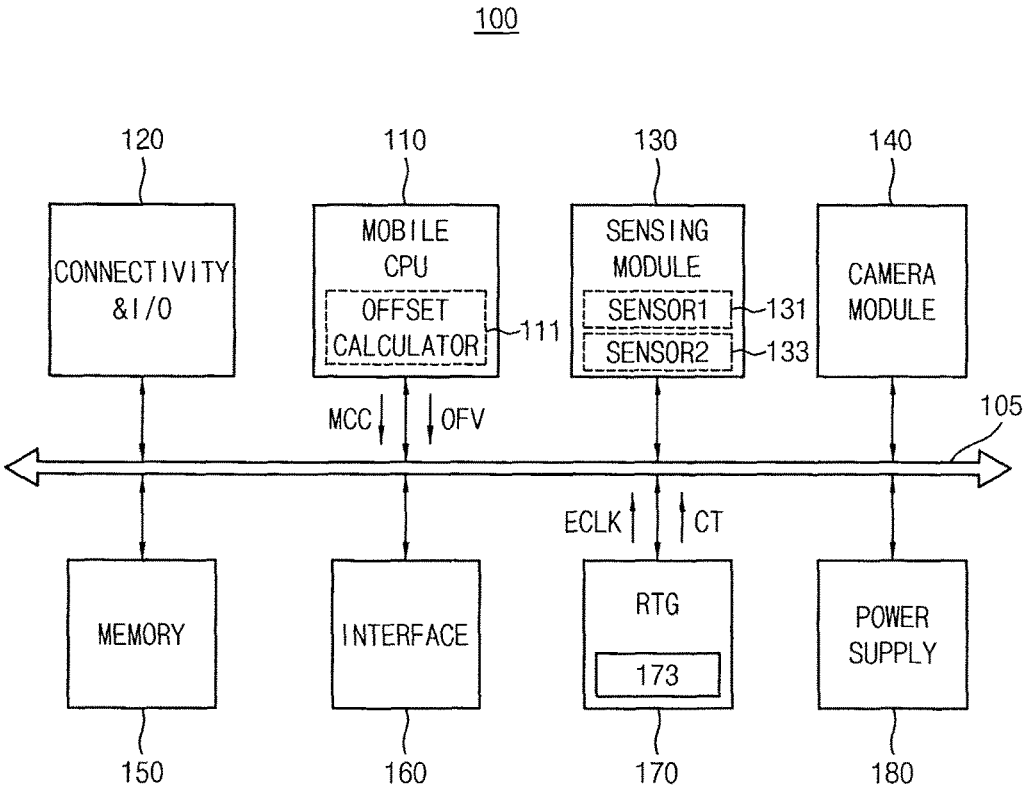
FIG. 2 is a block diagram illustrating an example of the application processor in FIG. 1 according to an exemplary embodiment of the present inventive concept.

FIG. 2 is a block diagram illustrating an example of the application processor in FIG. 1 according to an exemplary embodiment of the present inventive concept.

Referring to FIG. 2, the application processor 100 may include a mobile central processing unit (CPU) 110, a connectivity and input/output unit 120, a sensing module 130, a camera module 140, a memory 150, an interface 160, a real time generator 170, and a power supply 180 which are connected to each other via a system bus 105.

The mobile CPU 110 may control an overall operation of the application processor 100 and may include an offset calculator that generates the time offset OFS.

The connectivity and input/output unit 120 may communicate with an external device, and may receive/output data from/to a user. The connectivity and input/output unit 120 may include a baseband chipset and may perform Bluetooth communication.

The sensing module 130 may sense a current status of the display device 10 such as a user's contact and may generate sensing signals for controlling the display device 10. The sensing module 130 may include an acceleration sensor 131 and a gyro sensor 133. The acceleration sensor 131 may be a device that converts a change of acceleration with respect to one direction to an electrical signal. The gyro sensor 133 may sense an inclination of the display device 10 and may generate a sensing signal indicating an inclined amount.

The camera module 140 may include an image sensor and may process image frames such as still images or moving images captured by the image sensor in an image-capturing mode. The camera module 140 may display the processed image frames in the display panel 500. The image frames processed by the cameral module 140 may be stored in the memory 150 or may be transmitted to an external device via the connectivity and input/output unit 120.

The memory 120 may store programs for processing and controlling the mobile CPU 110 and may temporarily store data that are input or output. The memory 160 may include at least one storage media such as a flash memory type, a hard disk type, a multimedia card micro type, a random access memory (RAM), and a read-only memory (ROM).

The interface 160 may perform interfacing with the DDI 200. The interface 160 may perform high speed serial interfacing with the DDI 200. For example, the mobile CPU 110 may provide the DDI 200 with the time offset OFV generated by the offset calculator 111 via the interface 160.

The real time generator 170 may include a crystal oscillator 173, and may generate the current time CT corresponding to the real time and the clock signal ECLK. The current time CT may be provided to the DDI 200 vial the interface 160. In addition, the current time CT may be provided to the offset calculator 111.

The power supply 180 may provide power required for operating the display device 10. The power supply 180 may include a rechargeable battery. When the display device 10 is a portable device such as a wearable device, capacity of the power supply 180 is limited. Therefore, reduction of power consumption of the display device 10 is important.

Figure 3:
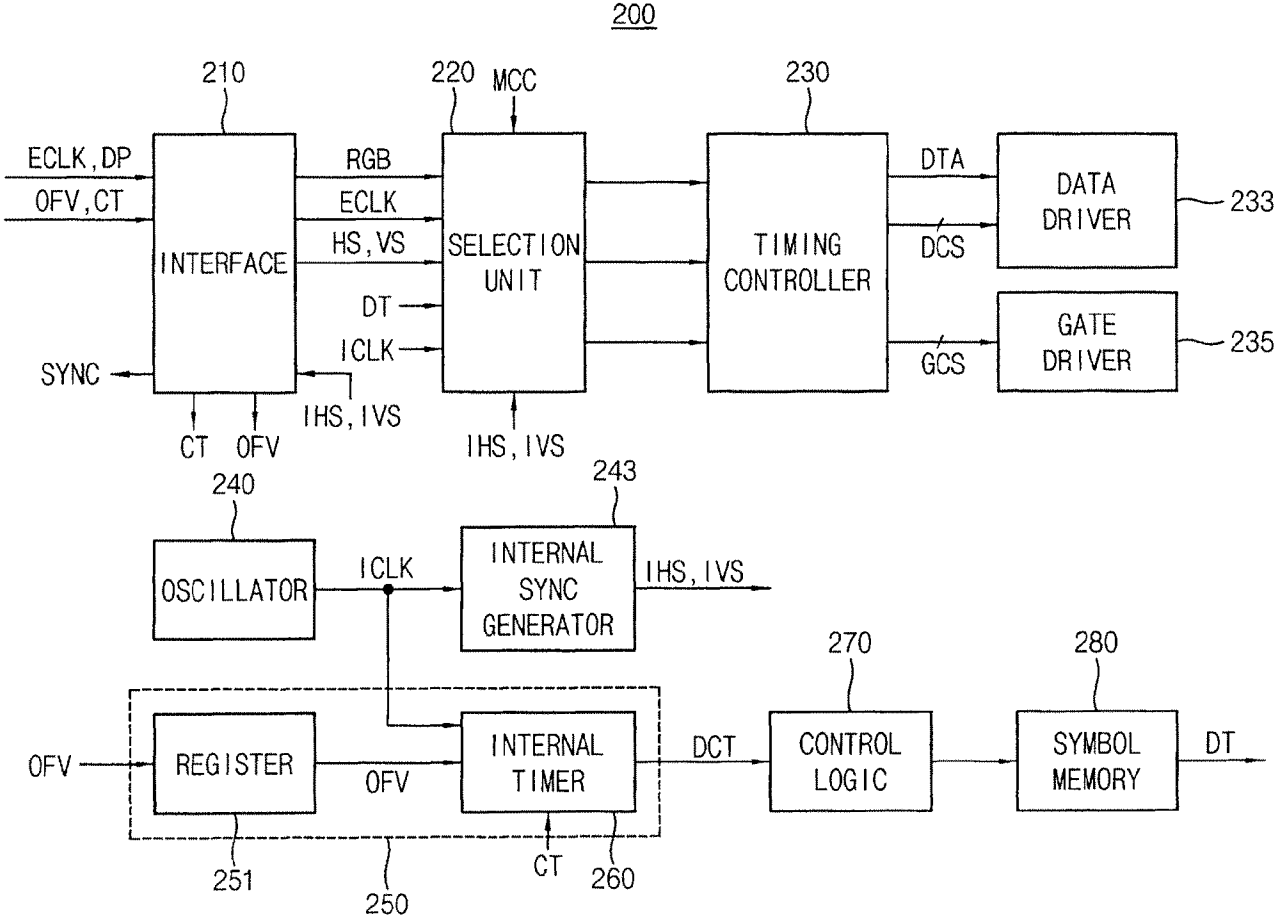
FIG. 3 is a block diagram illustrating an example of the display driver integrated circuit (DDI) in FIG. 1 according to an exemplary embodiment of the present inventive concept.

FIG. 3 is a block diagram illustrating an example of the display driver integrated circuit (DDI) in FIG. 1 according to an exemplary embodiment of the present inventive concept.

Referring to FIG. 3, the DDI 200 may include an interface 210, a selection unit 220, a timing controller 230, a data driver 233, a gate driver 235, an oscillator 240, an internal synchronization signal generator 243, a timer logic circuit 250, a control logic circuit 270, and a symbol memory 280.

The interface 210 may receive a clock signal ECLK, the data packet DP, the time offset OFV, and the current time CT from the application processor 100, and may provide the synchronization signal SYNC to the application processor 100. The interface 210 may provide the timer logic circuit 250 with the time offset OFV and the current time CT. The interface 210 may also provide the selection unit 220 with the clock signal ECLK, image data RGB included in the data packet DP, a horizontal synchronization signal HS, and a vertical synchronization signal VS.

The selection unit 220 may further receive a time to be displayed DT, an internal clock signal ICLK, an internal horizontal synchronization signal IHS, and an internal vertical synchronization signal IVS. The selection unit 220 may select one of the image data RGB and the time to be displayed DT, and may provide the selected one of the image data RGB and the time to be displayed DT to the timing controller 230 in response to a mode change signal MCC. The selection unit 220 may also select one of the clock signal ECLK and the internal clock signal ICLK, and may provide the selected one of the clock signal ECLK and the internal clock signal ICLK to the timing controller 230 in response to the mode change signal MCC. The selection unit 220 may also select one pair of the synchronization signals HS and VS and the internal synchronization signals IHS and IVS, and may provide the selected pair of the synchronization signals HS and VS and the internal synchronization signals IHS and IVS to the timing controller 230 in response to the mode change signal MCC.

The timing controller 230 may provide the data driver 233 with one of the image data RGB and the time to be displayed DT as a display data DTA. The timing controller 230 may generate a data control signal DCS for controlling the data driver 233 and a gate control signal GCS for controlling the gate driver 235. The timing controller 230 may provide the data control signal DCS to the data driver 233 and may provide the gate control signal GCS to the gate driver 235, based one pair of the synchronization signals HS and VS and the internal synchronization signals IHS and IVS. The data driver 233 and the gate driver 235 may display the display data DTA as the display data DDTA in units of frames, based on the data control signal DCS and the gate control signal GCS.

The oscillator 240 may generate the internal clock signal ICLK and may provide the internal clock signal ICLK to the internal synchronization signal generator 243 and the timer logic circuit 250. The internal synchronization signal generator 243 may divide the internal clock signal ICLK and may generate the internal horizontal synchronization signal IHS and the internal vertical synchronization signal IVS. The internal synchronization signal generator 243 may provide the internal horizontal synchronization signal IHS and the internal vertical synchronization signal IVS to the interface 210 and the selection unit 220. The interface 210 may provide the application processor 100 with one of the internal horizontal synchronization signal IHS and the internal vertical synchronization signal IVS as the synchronization signal SYNC. The internal vertical synchronization signal IVS may have a frequency of about 60 Hz.

The timer logic circuit 250 may include a register 251 and an internal timer 260. The timer logic circuit 250 may receive the time offset OFV and the current time CT and the internal clock signal ICLK, and may provide the control logic circuit 270 with digital time information DCT corresponding to the time to be displayed, based on the time offset OFV, the current time CT, and the internal clock signal ICLK. The register 251 may store the time offset OFV and may provide the time offset OFV to the internal timer 260. The internal timer 260 may generate the digital time information DT based on the time offset OFV, the current time CT, and the internal clock signal ICLK.

The control logic circuit 270 may receive the digital time information DCT and may provide the symbol memory 280 with addresses associated with timing symbols corresponding to the digital time information DCT. The symbol memory 280 may output, to the selection unit 220, the timing symbols designated by the addresses as the time to be displayed DT, in response to the addresses from the control logic circuit 270.

Figure 4:
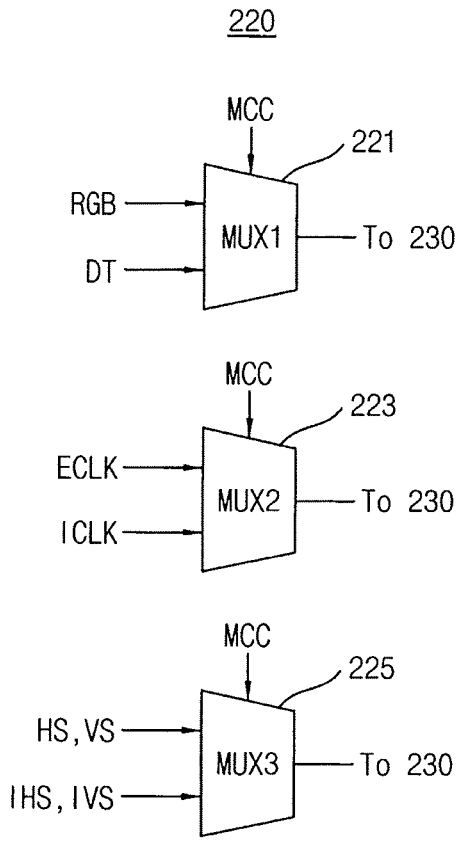
FIG. 4 is a circuit diagram illustrating the selection unit in FIG. 3 according to an exemplary embodiment of the present inventive concept.

FIG. 4 is a circuit diagram illustrating the selection unit in FIG. 3 according to an exemplary embodiment of the present inventive concept.

Referring to FIG. 4, the selection unit 220 may include first through third multiplexers 221, 223, and 225.

The first multiplexer 221 may select one of the image data RGB and the time to be displayed DT, and may provide the selected one of the image data RGB and the time to be displayed DT to the timing controller 230 in response to the mode change signal MCC. For example, the first multiplexer 221 may select the image data RGB when the mode change signal MCC directs the video mode. The first multiplexer 221 may select the time to be displayed DT when the mode change signal MCC directs the self clock display mode. The second multiplexer 223 may select one of the clock signal ECLK and the internal clock signal ICLK, and may provide the selected one the clock signal ECLK and the internal clock signal ICLK to the timing controller 230 in response to the mode change signal MCC. For example, the second multiplexer 223 may select the clock signal ECLK when the mode change signal MCC directs the video mode. The second multiplexer 223 may select the internal clock signal ICLK when the mode change signal MCC directs the self clock display mode. The third multiplexer 225 may select one pair of the synchronization signals HS and VS and the internal synchronization signals IHS and IVS, and may provide the selected pair of the synchronization signals HS and VS and the internal synchronization signals IHS and IVS to the timing controller 230 in response to the mode change signal MCC. For example, the third multiplexer 225 may select the synchronization signals HS and VS when the mode change signal MCC directs the video mode. The third multiplexer 225 may select the internal synchronization signals IHS and IVS when the mode change signal MCC directs the self clock display mode.

Figure 5:
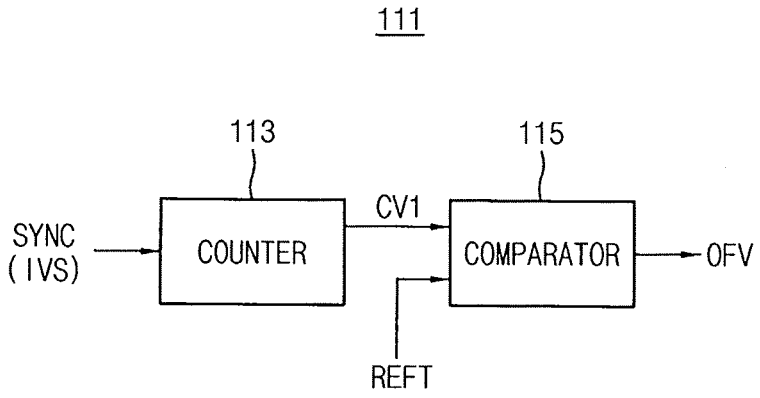
FIG. 5 is a block diagram illustrating an example of the offset calculator in FIG. 2 according to an exemplary embodiment of the present inventive concept.

FIG. 5 is a block diagram illustrating an example of the offset calculator in FIG. 2 according to an exemplary embodiment of the present inventive concept.

Referring to FIG. 5, the offset calculator 111 may include a counter 113 and a comparator 115. The counter 113 may count the synchronization signal SYNC (e.g., the internal vertical synchronization signal IVS) to a predetermined number, and may output a counting value CV1 to the comparator 115. The comparator 115 may compare the counting value CV1 and a reference time value REFT, and may output the time offset OFV indicating a difference between the counting value CV1 and the reference time value REFT. The reference time value REFT may be provided from the real time generator 170 in FIG. 2.

Figure 6:
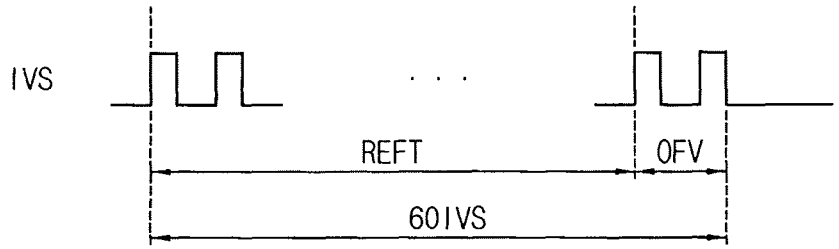
FIG. 6 is a timing diagram illustrating that the time offset is calculated.

FIG. 6 is a timing diagram illustrating that the time offset is calculated.

Referring to FIGS. 5 and 6, when a frequency of the internal vertical synchronization signal IVS is 60 Hz, sixty clocks must be counted during one second. However, when the oscillator 240 which serves as a base for generating the internal vertical synchronization signal IVS is an RC oscillator, an error may occur in the internal vertical synchronization signal IVS. Therefore, a time required for the internal vertical synchronization signal IVS to toggle sixty times may be greater than the reference time value REFT. The difference between the time required for the internal vertical synchronization signal IVS and the reference time value REFT may correspond to the time offset OFV.

Figure 7:
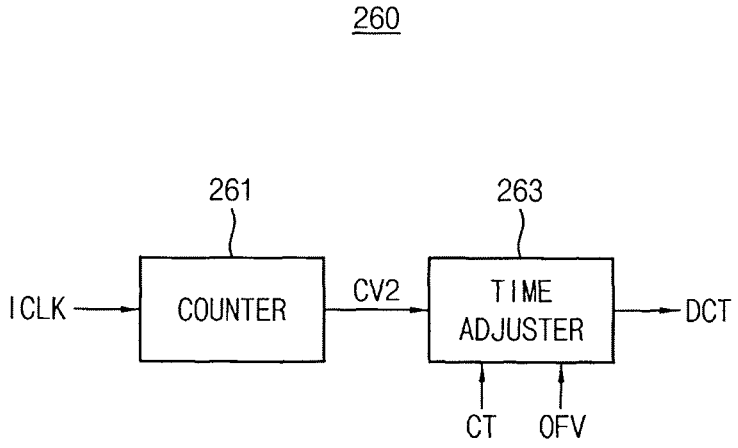
FIG. 7 is a block diagram illustrating an example of the internal timer in FIG. 3 according to an exemplary embodiment of the present inventive concept.

FIG. 7 is a block diagram illustrating an example of the internal timer in FIG. 3 according to an exemplary embodiment of the present inventive concept.

Referring to FIG. 7, the internal timer 260 may include a counter 261 and a time adjuster 263. The counter 261 may count the internal clock signal ICLK and may output a counting value CV2 indicating the counted internal clock signal ICLK. The time adjuster 263 may receive the counting value CV2, the current time CT, and the time offset OFV, and may output the digital time information DCT corresponding to the time to be displayed based on the counting value CV2, the current time CT, and the time offset OFV. The time adjuster 263 may output periodically the digital time information DCT based on the counting value CV2 after the time adjuster 263 receives the current time CT. The time adjuster 263 may output the digital time information DCT corresponding to the real time by correcting errors of the counting value CV2 based on the time offset OFV. For example, when the counting value CV2 is less than the reference time value REFT based on the current time CT, the time adjuster 263 may add the counting value CV2 and the time offset OFV to the current time CT, and may output the digital time information DCT. In addition, when the counting value CV2 is greater than the reference time value REFT based on the current time CT, the time adjuster 263 may sequentially add the counting value CV2 to the current time CT and subtract the time offset OFV from the current time CT, and may output the digital time information DCT.

Figure 8:
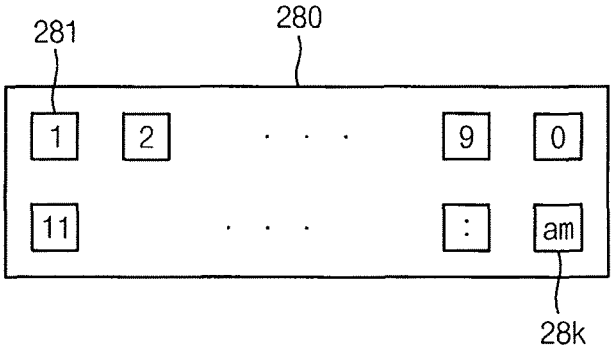
FIG. 8 illustrates the symbol memory in FIG. 3 according to an exemplary embodiment of the present inventive concept.

FIG. 8 illustrates the symbol memory in FIG. 3 according to an exemplary embodiment of the present inventive concept.

Referring to FIG. 8, the symbol memory 280 may store a plurality of timing symbols 281~28*k* that are used for displaying the time to be displayed. The symbol memory 280 may provide the selection unit 220 with timing symbols of the plurality of timing symbols 281~28*k* associated with the digital time information DCT as the time to be displayed in response to addresses from the control logic circuit 270. The symbol memory 280 may be implemented separately from the graphic memory or may be implemented as a portion of the graphic memory.

Figure 9:
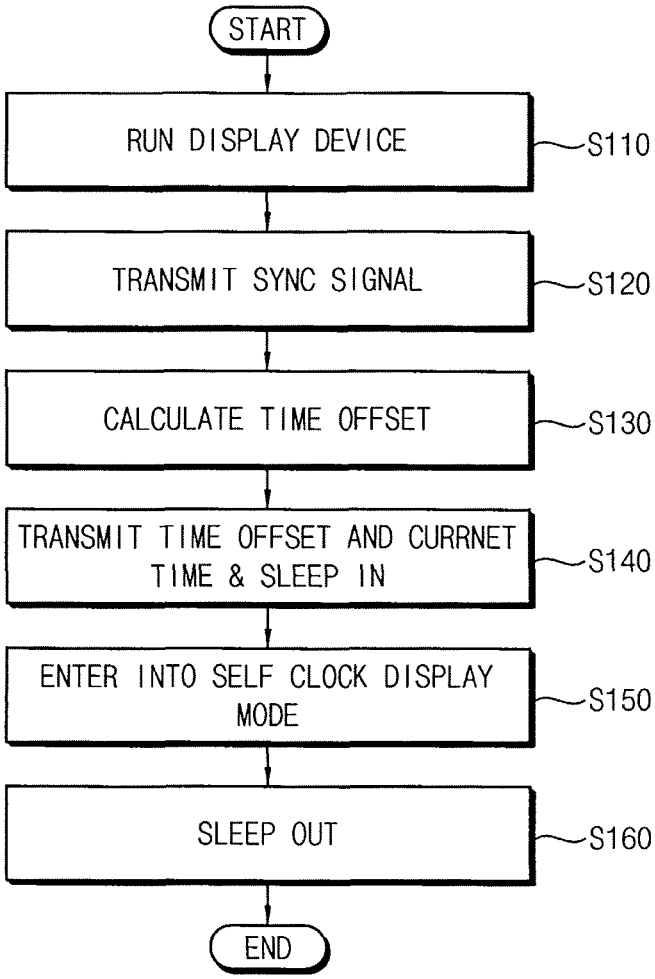
FIGS. 9 and 10 are flow charts illustrating operation of the display device of FIG. 1 according to an exemplary embodiment of the present inventive concept.
Figure 10:
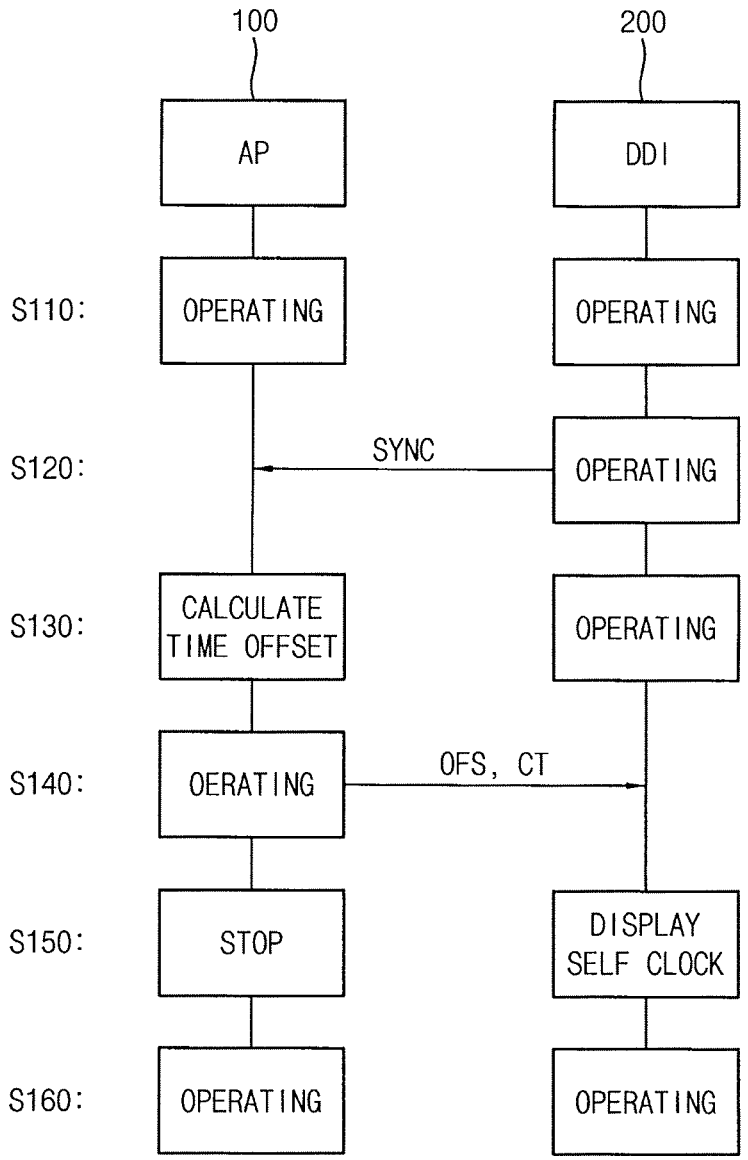

FIGS. 9 and 10 are flowcharts illustrating operation of the display device of FIG. 1 according to an exemplary embodiment of the present inventive concept.

Hereinafter, an operation of the display device 10 will be described in detail with reference to FIGS. 1 through 10.

The display device 10 is run (S110). When the display device 10 is run, the application processor 100 and the DDI 200 may be in an operating state. When the DDI 200 does not receive the image data RGB from the application processor 100 for a predetermined time, the DDI 200 may transmit the synchronization signal SYNC to the application processor 100 for entering into the self clock display mode (S210). When the application processor 100 receives the synchronization signal SYNC, the application processor 100 (e.g., the mobile CPU 110) may calculate the time offset OFV corresponding to a difference between the synchronization signal SYNC and the current time CT based on the real time, by counting toggling of the synchronization signal SYNC (S130). The application processor 100 may transmit the time offset OFV and the current time CT to the DDI 200 (S140). The application processor 100 may enter into a sleep mode after transmitting the time offset OFV and the current time CT to the DDI 200. The DDI 200 may enter into the self clock display mode and may calculate the time to be displayed DT based on the time offset OFV and the current time CT. The DDI 200 may display the time to be displayed DT in the display panel 500 periodically (S150). In the self clock display mode, interfacing relationship between the application processor 100 and the DDI 200 may be cut off. When the data such as the image data RGB is to be transmitted from the application processor 100 to the DDI 200, the application processor 100 may exit from the sleep mode (S160).

Figure 11:
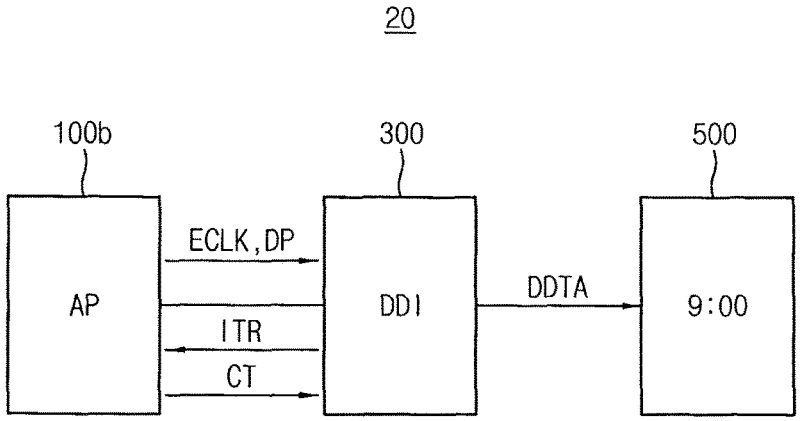
FIG. 11 is a block diagram illustrating an example of a display device according to an exemplary embodiment of the present inventive concept.

FIG. 11 is a block diagram illustrating another example of a display device according to an exemplary embodiment of the present inventive concept.

Referring to FIG. 11, a display device 20 may include an application processor 100*b*, a DDI 300, and a display panel 500.

The application processor 100*b* may control an overall operation of the display device 20. The application processor 100 may provide the DDI 200 with a data packet DP including image data in response to a clock signal ECLK. The data packet DP may include the image data, a horizontal synchronization signal, a vertical synchronization signal, and a data enable signal.

In addition, the application processor 100*b* may provide the DDI 300 with a current time CT indicating a real time in response to an interrupt signal ITR provided from the DDI 300.

The DDI 300, in a video mode, may process the image data in the data packet DP and may output display data DDTA to the display panel 500. In addition, the DDI 300, in a self clock display mode, may calculate internally the time offset OFV and may adaptively adjust a receiving period of current time CT from the application processor 100*b* based on the time offset OFV. The time offset OFV may correspond to a difference between the real time and an internal clock signal that is internally generated in the DDI 300. The DDI 300 may include an RC oscillator that generates the internal clock signal. The internal clock signal may have an error with respect to the real time, and the error may correspond to the time offset OFV. For example, the DDI 300, in the self clock display mode, may reduce power consumption by adaptively adjusting the receiving period (or updating the period) of the current time CT from the application processor 100, calculating the time to be displayed, and outputting the time to be displayed as the display data DDTA in the display panel 500.

In an exemplary embodiment, the application processor 100*b* and the DDI 300 may provide an interface such as an MIPI, an MDDI, a CDP, or the like. In an exemplary embodiment, the DDI 300 may include a graphic memory for a high speed serial interface (HSSI). When the graphic memory is not used, the DDI 300 may consume more power and produce more heat. Further, the load on the application processor 100*b* may be reduced when the graphic memory is included within the DDI 300. Display data that is input from the application processor 100*b* may be written into the graphic memory, and data stored in the graphic memory may be output through a scan operation. In an exemplary embodiment, the graphic memory may be a dual port DRAM.

Figure 12:
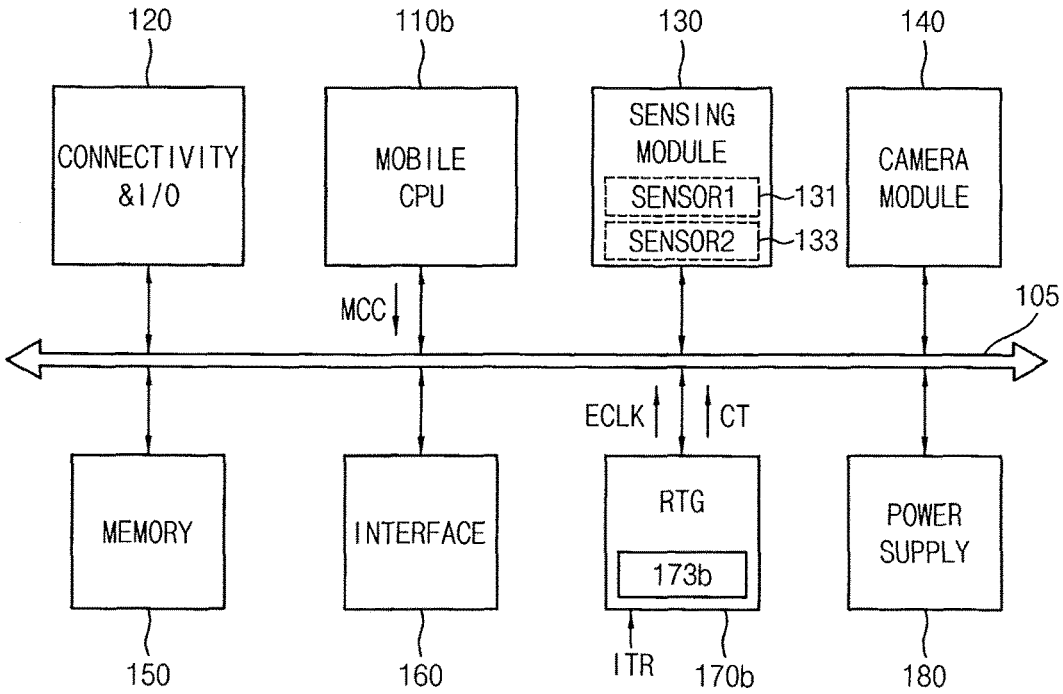
FIG. 12 is a block diagram illustrating an example of the application processor in FIG. 11 according to an exemplary embodiment of the present inventive concept.

FIG. 12 is a block diagram illustrating an example of the application processor in FIG. 11 according to an exemplary embodiment of the present inventive concept.

Referring to FIG. 12, the application processor 100*b* may include a mobile CPU 110*b*, a connectivity and input/output unit 120, a sensing module 130, a camera module 140, a memory 150, an interface 160, a real time generator 170*b*, and a power supply 180 which are connected to each other via a system bus 105.

The application processor 100*b* of FIG. 12 may differ from the application processor 100 of FIG. 2 in operations of the mobile CPU 110*b* and the real time generator 170*b*, and thus there will be description on the operations of the mobile CPU 110*b* and the real time generator 170*b*, and description on operations of other components will be omitted.

The mobile CPU 110*b* may control an overall operation of the application processor 100*b*. The mobile CPU 110*b* may output a mode change signal MCC directing an operating mode of the DDI 300.

The real time generator 170*b* may include a crystal oscillator 173*b* and may generate the current time CT corresponding to the real time and the clock signal ECLK. The real time generator 170*b* may provide the current time CT to the DDI 300 whenever the real time generator 170*b* receives the interrupt signal ITR from the DDI 300.

Figure 13:
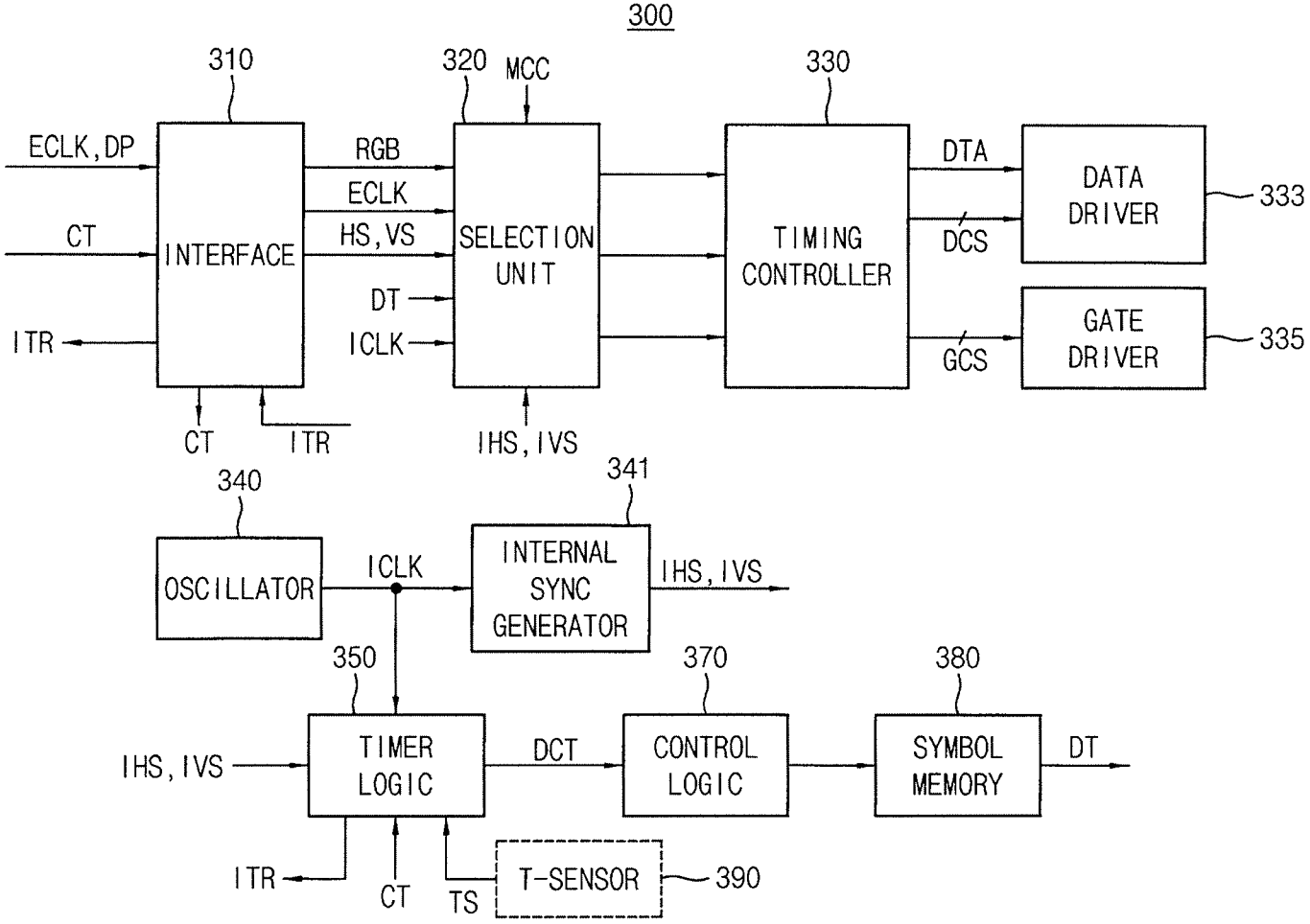
FIG. 13 is a block diagram illustrating an example of the DDI in FIG. 11 according to an exemplary embodiment of the present inventive concept.

FIG. 13 is a block diagram illustrating an example of the DDI in FIG. 11 according to an exemplary embodiment of the present inventive concept.

Referring to FIG. 13, the DDI 300 may include an interface 310, a selection unit 320, a timing controller 330, a data driver 333, a gate driver 335, an oscillator 340, an internal synchronization signal generator 341, a timer logic circuit 350, a control logic circuit 370, and a symbol memory 380. The DDI may further include a temperature sensor 390. The temperature sensor 390 may sense an operating temperature of the DDI 300 and may provide a temperature signal TS to the timer logic circuit 350. The temperature sensor 390 may provide the timer logic circuit 350 with the temperature signal TS that is activated when the sensed operating temperature is out of a reference time range.

The interface 310 may receive the clock signal ECLK, the data packet DP and the current time CT from the application processor 100*b*, and may provide the interrupt signal ITR to the application processor 100*b*. The interface 310 may provide the timer logic circuit 350 with the current time CT. The interface 310 may also provide the selection unit 320 with the clock signal ECLK, image data RGB included in the data packet DP, a horizontal synchronization signal HS, and a vertical synchronization signal VS.

The selection unit 320 may further receive a time to be displayed DT, an internal clock signal ICLK, an internal horizontal synchronization signal IHS, and an internal vertical synchronization signal IVS. The selection unit 320 may select one of the image data RGB and the time to be displayed DT, and may provide the selected one of the image data RGB and the time to be displayed DT to the timing controller 330 in response to the mode change signal MCC. The selection unit 320 may also select one of the clock signal ECLK and the internal clock signal ICLK, and may provide the selected one of the clock signal ECLK and the internal clock signal ICLK to the timing controller 330 in response to the mode change signal MCC. The selection unit 320 may also select one pair of the synchronization signals HS and VS and the internal synchronization signals IHS and IVS, and may provide the selected pair of the synchronization signals HS and VS and the internal synchronization signals IHS and IVS to the timing controller 330 in response to the mode change signal MCC.

The timing controller 330 may provide the data driver 333 with one of the image data RGB and the time to be displayed DT as a display data DTA. The timing controller 330 may generate a data control signal DCS for controlling the data driver 233 and a gate control signal GCS for controlling the gate driver 335. The timing controller 330 may provide the data control signal DCS to the data driver 333 and may provide the gate control signal GCS to the gate driver 335, respectively, based one pair of the synchronization signals HS and VS and the internal synchronization signals IHS and IVS. The data driver 333 and the gate driver 335 may display the display data DTA as the display data DDTA in units of frames, based on the data control signal DCS and the gate control signal GCS.

The oscillator 340 may generate the internal clock signal ICLK, and may provide the internal clock signal ICLK to the internal synchronization signal generator 341 and the timer logic circuit 350. The internal synchronization signal generator 341 may divide the internal clock signal ICLK, and may generate the internal horizontal synchronization signal IHS and the internal vertical synchronization signal IVS.

The internal synchronization signal generator 341 may provide the internal horizontal synchronization signal IHS and the internal vertical synchronization signal IVS to the selection unit 320. The internal vertical synchronization signal IVS may have a frequency of about 60 Hz.

The timer logic circuit 350 may receive the internal synchronization signals IHS and IVS, the current time CT, and the internal clock signal ICLK, and may provide the control logic circuit 370 with a digital time information DCT corresponding to the time to be displayed based on the internal synchronization signals IHS and IVS, the current time CT, and the internal clock signal ICLK. In addition, the timer logic circuit 350 may provide the application processor 100*b* with the interrupt signal ITR for receiving the current time CT via the interface 310.

The control logic circuit 370 may receive the digital time information DCT, and may provide the symbol memory 380 with addresses associated with timing symbols corresponding to the digital time information DCT. The symbol memory 380 may output to the selection unit 320 the timing symbols designated by the addresses as the time to be displayed DT, in response to the addresses from the control logic circuit 370.

A configuration of the selection unit 320 may be substantially the same as the configuration of the selection unit 220 of FIG. 4.

Figure 14:
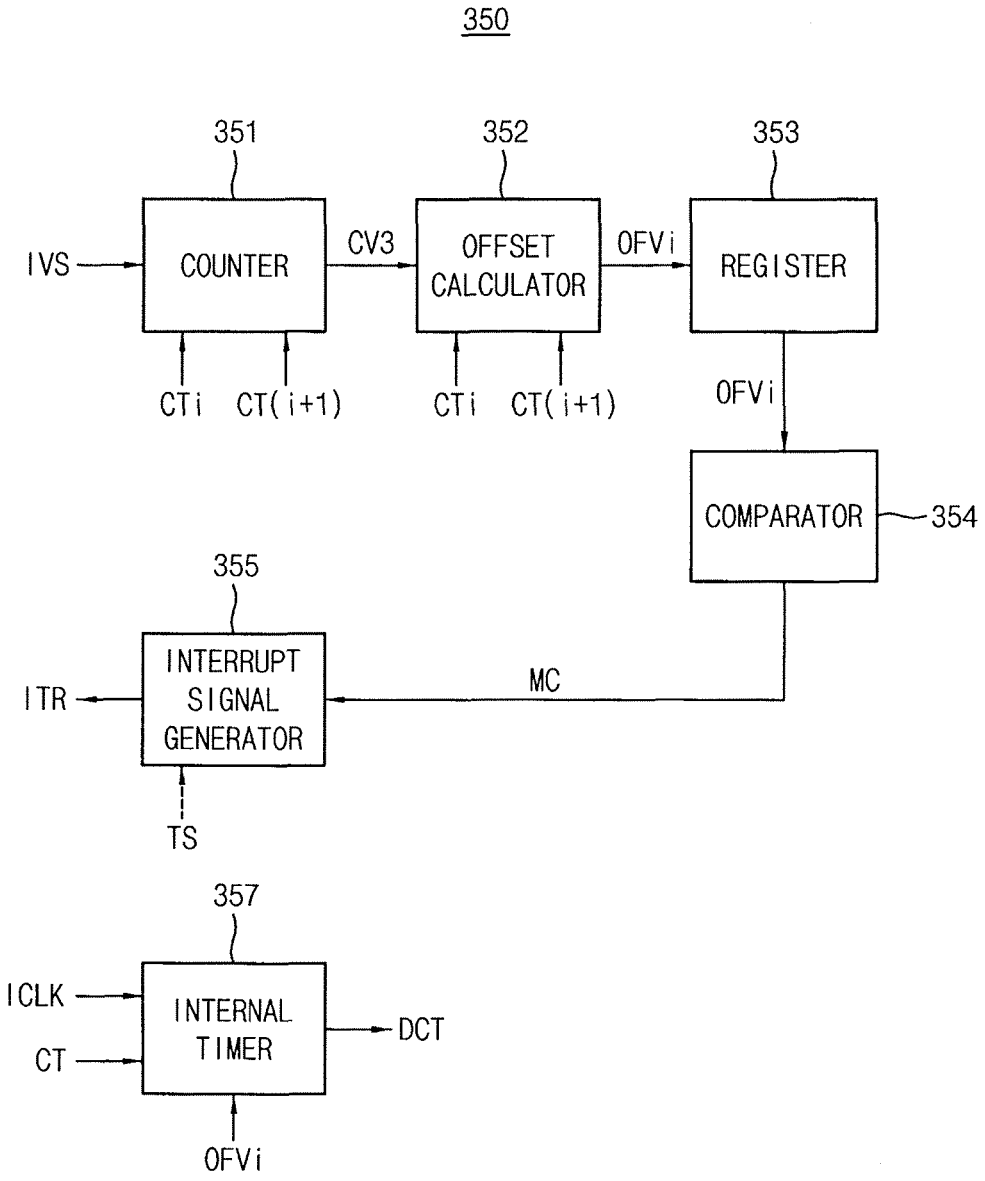
FIG. 14 is a block diagram illustrating an example of the timer logic circuit in FIG. 13 according to an exemplary embodiment of the present inventive concept.

FIG. 14 is a block diagram illustrating an example of the timer logic circuit in FIG. 13 according to an exemplary embodiment of the present inventive concept.

Referring to FIG. 14, the timer logic circuit 350 may include a counter 351, an offset calculator 352, a register 353, a comparator 354, an interrupt signal generator 355, and an internal timer 357.

The counter 351 may count toggling numbers of the internal vertical synchronization signal IVS during each time interval between current times CT(i) and CT(i+1) which are consecutively received, and may output a counting value CV3 indicating the toggling numbers of the internal vertical synchronization signal IVS during each time interval. The offset calculator 352 may calculate a difference of the counting value CV3 and each time interval between the current times CT(i) and CT(i+1) which are consecutively received, and may output each time offset OFVi to the register 353. The register 353 may store the time offsets OFVi. The comparator 354 may compare two consecutive time offsets of the time offsets OFVi stored in the register 353, and may provide the interrupt signal generator 355 with a digital code indicating a difference between the two consecutive time offsets. The interrupt signal generator 355 may adaptively adjust an activation period of the interrupt signal ITR according to the digital code MC. For example, when the digital code MC indicates that the two consecutive time offsets are substantially the same as each other, the interrupt signal generator 355 may increase the activation interval of the interrupt signal ITR. For another example, when the digital code MC indicates that the two consecutive time offsets are different from each other, the interrupt signal generator 355 may maintain or decrease the activation interval of the interrupt signal ITR. The interrupt signal generator 355 may activate the interrupt signal ITR and may provide the activated interrupt signal ITR to the application processor 100*b* regardless of the digital code MC when the interrupt signal generator 355 receives the temperate signal TS which is activated.

The internal timer 357 may periodically generate the digital time information DCT corresponding to the real time based on the internal clock signal ICLK, the current time CT, and the time offsets OFVi. A configuration of the internal timer 357 may be substantially the same as the configuration of the internal timer 260 of FIG. 7.

Figure 15:
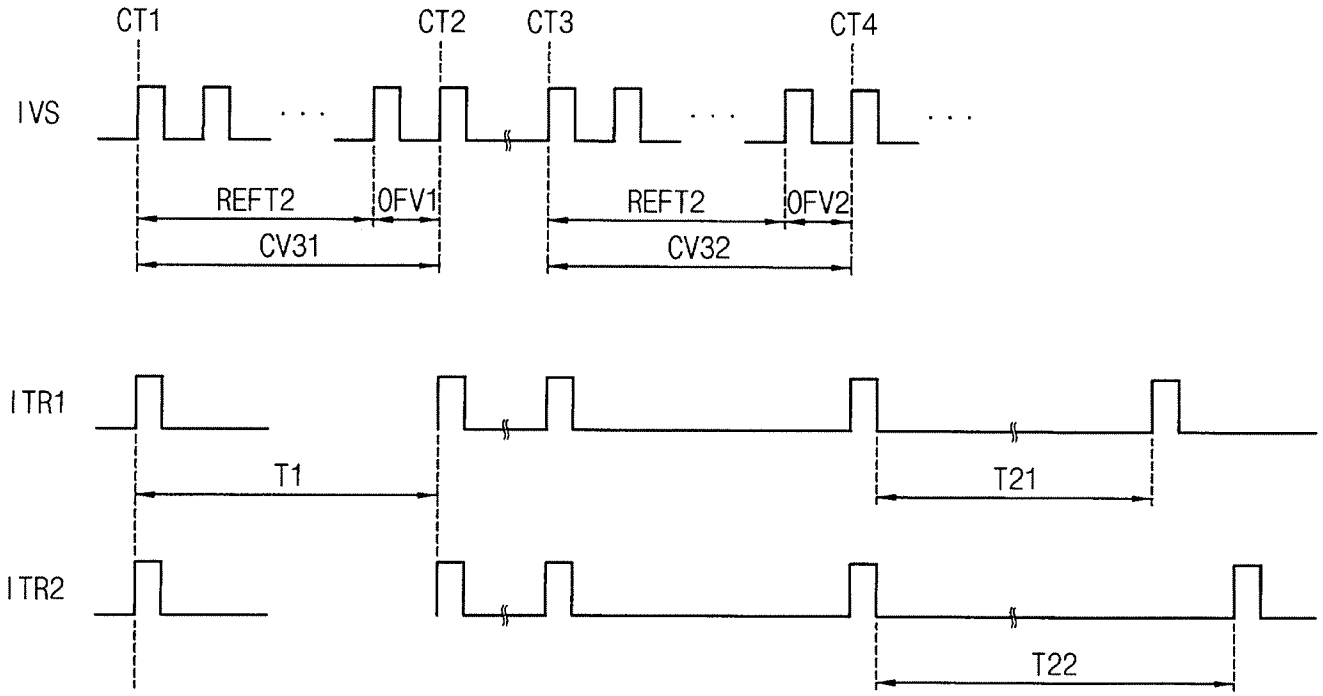
FIG. 15 illustrates various signals in the timer logic circuit of FIG. 14 according to an exemplary embodiment of the present inventive concept.

FIG. 15 illustrates various signals in the timer logic circuit of FIG. 14 according to an exemplary embodiment of the present inventive concept.

Referring to FIGS. 14 and 15, the counter 351 may output a counting value CV31 by counting toggling numbers of the internal vertical synchronization signal IVS during a time interval between current times CT(1) and CT(2), and may output a counting value CV32 by counting toggling numbers of the internal vertical synchronization signal IVS during a time interval between current times CT(2) and CT(3). The offset calculator 352 may calculate a time offset OFV1 by comparing a reference time value REFT2 with the counting value CV31, may calculate a time offset OFV2 by comparing a reference time value REFT2 with the counting value CV32, and may store the time offsets OFV1 and OFV2 in the register 352. The comparator 354 may compare the time offsets OFV1 and OFV2 with each other, and may provide the interrupt signal generator 355 with the digital code MC indicating a difference between the time offsets OFV1 and OFV2. When the digital code MC indicates that the two consecutive time offsets OFV1 and OFV2 are different from each other, the interrupt signal generator 355 may maintain the activation interval of an interrupt signal ITR1. For example, periods T1 and T21 of the interrupt signal ITR1 may be the same as each other. When the digital code MC indicates that the two consecutive time offsets OFV1 and OFV2 are the same as each other, the interrupt signal generator 355 may increase the activation interval of an interrupt signal ITR2. For example, a period T22 may be greater than a period T1 with respect to an interrupt signal ITR2.

Therefore, the display device 20 may reduce power consumption because the DDI 300 determines whether the time offsets are the same, and adaptively adjusts the activation period of the interrupt signal ITR to increase the receiving period of the current time CT from the application processor 100*b*.

Figure 16:
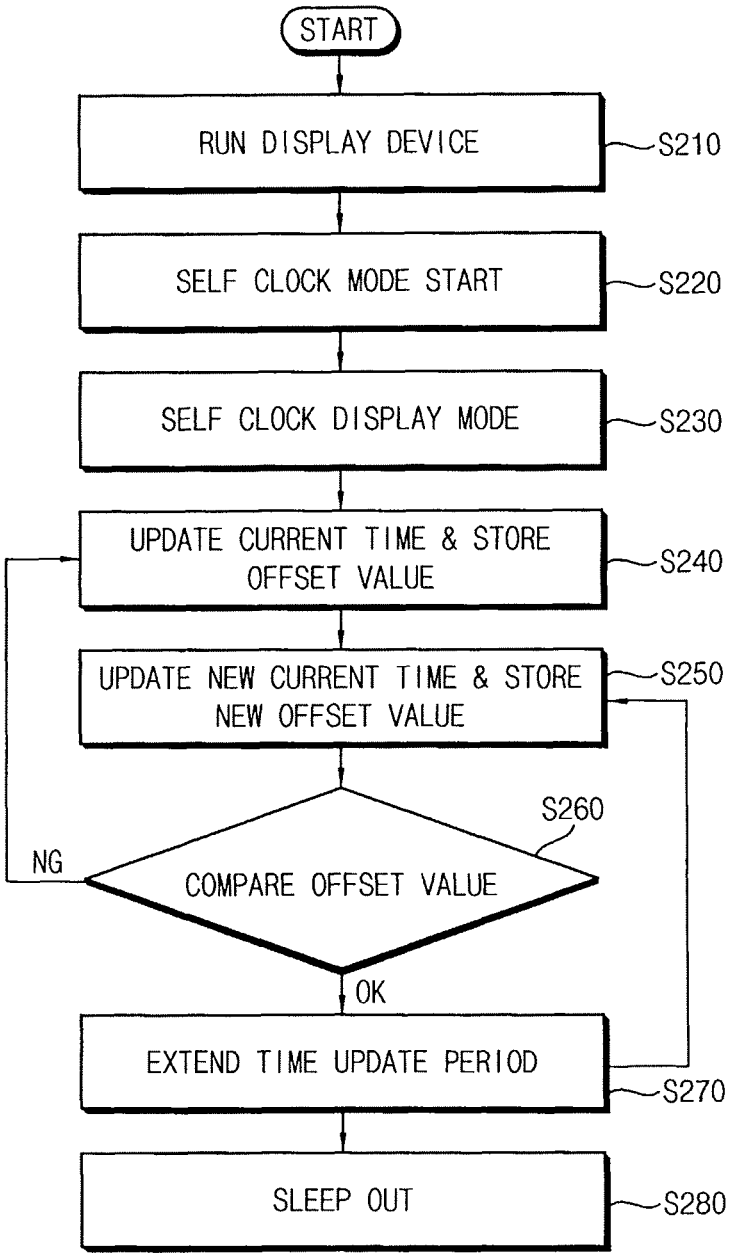
FIGS. 16 and 17 are flowcharts illustrating operation of the display device of FIG. 11 according to an exemplary embodiment of the present inventive concept.
Figure 17:
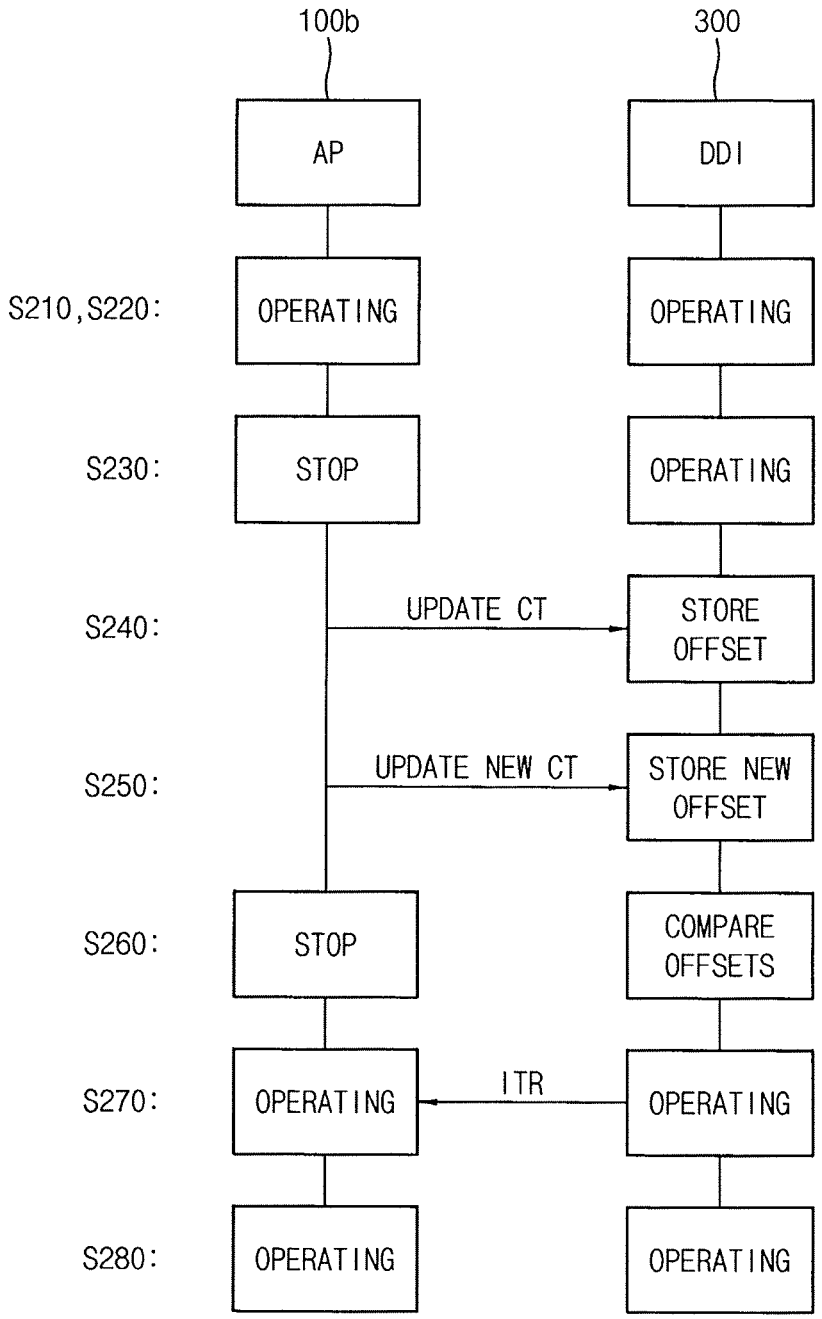

FIGS. 16 and 17 are flowcharts illustrating operation of the display device of FIG. 11 according to an exemplary embodiment of the present inventive concept.

Hereinafter, an operation of the display device 20 of FIG. 11 will be described in detail with reference to FIGS. 11 through 17.

The display device 20 is run (S210). When the display device 20 is run, the application processor 100*b* and the DDI 300 may be in operating state. When the DDI 300 does not receive the image data RGB from the application processor 100*b* for a predetermined time, a self clock display mode may begin (S220). In this case, the application processor 100*b* and the DDI 300 may also be in the operating state. The application processor 100*b* may enter into a sleep mode, and the DDI 300 may enter into a self clock display mode (S230). The application processor 100*b* may transmit (or update) the current time CT to the DDI 300 in response to the interrupt signal ITR from the DDI 300. The DDI 300 may calculate the time offset OFV based on the current time CT, and may store the time offset OFV in the register 353 (S240). After a predetermined time elapses, the application processor 100*b* may transmit (or update) a new current time CT to the DDI 300 in response to the interrupt signal ITR from the DDI 300, and the DDI 300 may calculate a new time offset OFV based on the new current time CT and may store the new time offset OFV in the register 353 (S250).

The comparator 354 may compare the time offsets with each other and may provide the interrupt signal generator 355 with the digital code MC indicating the difference between the time offsets. The interrupt signal generator 355 may determine whether the time offsets are the same as each other based on the digital code MC (S260). When the time offsets are the same as each other (OK in S260), the interrupt signal generator 355 may increase the activation period of the interrupt signal ITR (S270). In an exemplary embodiment, the interrupt signal generator 355 may provide the application processor 100*b* with information notifying that the activation period of the interrupt signal ITR is increased. When the time offsets are different from each other (NG in S260), the interrupt signal generator 355 may maintain the activation period of the interrupt signal ITR, and the operation may return to the step (S240). When the data is not received in the step (S270), the operation may return to the step (S250), and the application processor 100*b* may exit from the sleep mode (S280).

Figure 18:
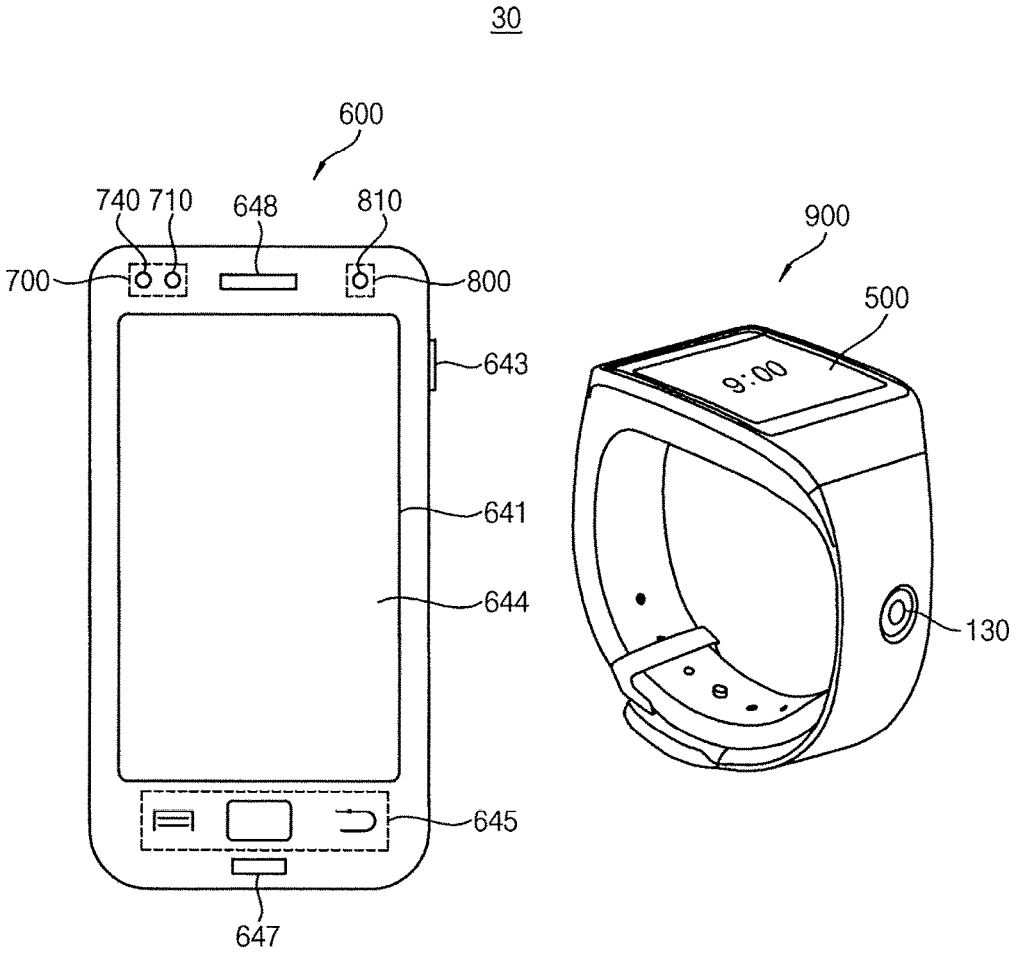
FIG. 18 is a block diagram illustrating a mobile electronic apparatus according to an exemplary embodiment of the present inventive concept.

FIG. 18 is a block diagram illustrating a mobile electronic apparatus according to an exemplary embodiment of the present inventive concept.

Referring to FIG. 18, a mobile electronic apparatus 30 may include a mobile device 600 and a display device 900. The mobile device 600 may be a smart phone, and the display device 900 may be a watch-type wearable device that operates in cooperation with the mobile device 600.

The display device 900 may employ the display device 10 of FIG. 1 or the display device 20 of FIG. 11, and may operate in a self clock display mode to reduce power consumption. The display device 900 may include the display panel 500 and the camera module 130.

The display device 900 may operate in cooperation with the mobile device 600, and may display in the display panel 500 messages or phone calls received by the mobile device 600. In addition, the display device 900 may transmit images captured by the camera module 130 to the mobile device 600. In addition, the display device 900 may run various applications independently from the mobile device 600.

The mobile device 600 may include a three-dimensional (3D) image sensor 700, a two-dimensional (2D) image sensor 800, and a display device 641. The mobile device 600 may further include a touch screen 644, buttons 643 and 645, a microphone 647, and a speaker 648.

The 3D image sensor 700 may be installed on a first surface (e.g., a front surface) of the mobile device 600. The 3D image sensor 700 may perform a first sensing to detect a proximity of a subject, and a second sensing to recognize a gesture of the subject by acquiring distance information for the subject. The 3D image sensor 700 may include a sensing unit 710 having a plurality of depth pixels, and may include a light source unit 740 for emitting an infrared ray or a near-infrared ray.

The 2D image sensor 800 may be installed on the first surface of the mobile device 600 and may perform a third sensing to acquire color image information for the subject. The 2D image sensor 800 may include a second sensing unit 810 having a plurality of color pixels.

Figure 19:
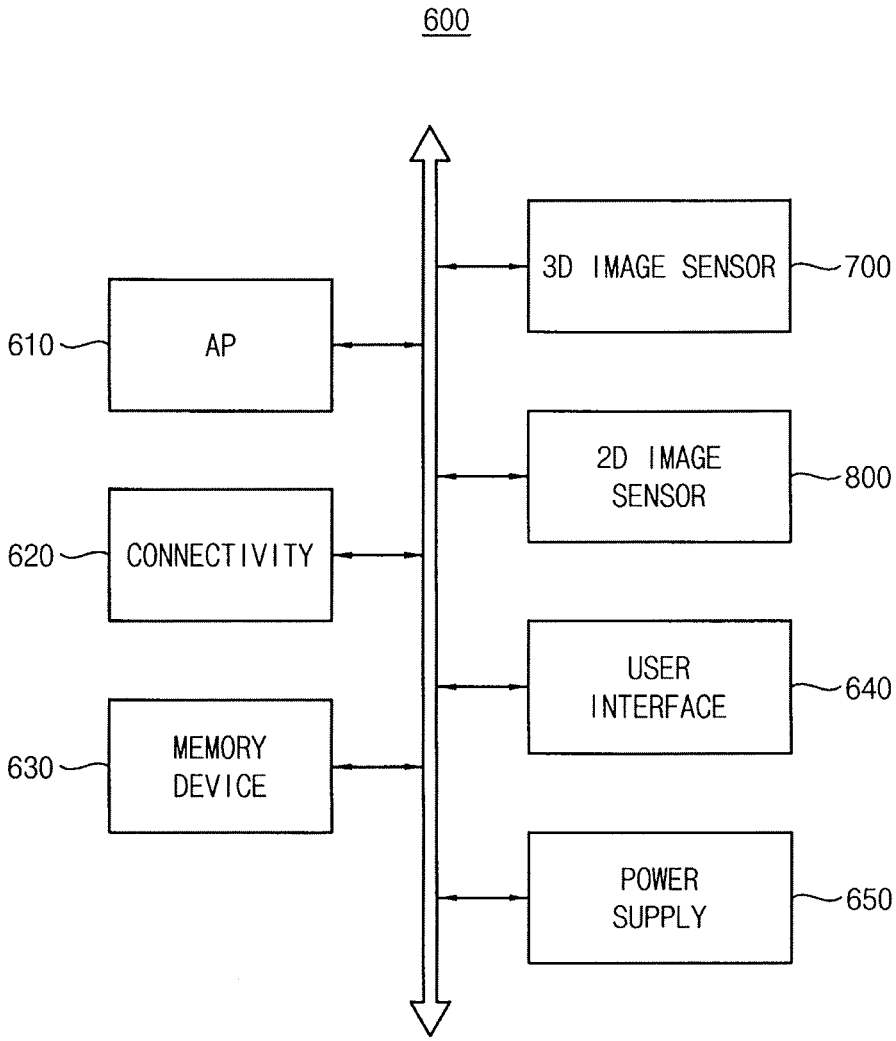
FIG. 19 is a block diagram illustrating the mobile device of FIG. 18 according to an exemplary embodiment of the present inventive concept.

In the exemplary embodiment illustrated in FIG. 19, the 3D image sensor 700 and the 2D image sensor 800 may be prepared as two integrated circuit chips separated from each other. For example, the mobile device 600 may include two sensing modules. In this case, the depth pixels and the color pixels may constitute two pixel arrays separated from each other.

The display device 641 may be installed on the first surface of the mobile device 600, and may display the results of the first sensing, the second sensing, and the third sensing.

FIG. 19 is a block diagram illustrating the mobile device of FIG. 18 according to an exemplary embodiment of the present inventive concept.

Referring to FIG. 19, the mobile device 600 may include an application processor 610, a connectivity unit 620, a memory device 630, a 3D image sensor 700, a 2D image sensor 800, a user interface 640, and a power supply 650. According to an exemplary embodiment of the present inventive concept, the mobile device 600 may be a predetermined mobile system, such as a mobile phone, a smart phone, a tablet PC, a laptop computer, a Personal Digital Assistant (PDA), a Portable Multimedia Player (PMP), a digital camera, a music player, a portable game console, a navigation system, or the like.

The application processor 610 may execute an operating system (OS) to operate the mobile device 600. In addition, the application processor 610 may execute various applications to provide an internet browser, a game, and a dynamic image. In addition, the application processor 610 may include a single core or multi-cores. In addition, the application processor 610 may further include a cache memory positioned inside or outside the application processor 610.

The connectivity unit 620 may communicate with external devices. For example, the connectivity unit 620 can perform Universal Serial Bus (USB) communication, Ethernet communication, Near Field Communication (NFC), Radio Frequency Identification (RFID) communication, mobile telecommunication or memory card communication. For example, the connectivity unit 620 may include a baseband chipset, and may support communications such as GSM, GPRS, WCDMA, HSxPA, or the like.

The memory device 630 may store data processed by the application processor 610 or may operate as a working memory. In addition, the memory device 630 may store a bottom image for booting the mobile device 600, a file system related to the operating system to operate the mobile device 600, a device driver related to external devices connected to the mobile device 600, and the applications executed in the mobile device 600. For example, the memory device 630 may include a volatile memory, such as a Dynamic Random Access Memory (DRAM), a Static Random Access Memory (SRAM), a mobile DRAM, a double data rate (DDR) synchronous DRAM (SDRAM), a low power DDR (LPDDR) SDRAM, a graphic DDR (GDDR) SDRAM, a Rambus DRAM (RDRAM), or the like, or may include a nonvolatile memory, such as an Electrically Erasable Programmable Read-Only Memory (EEPROM), a Flash Memory, a Phase Change Random Access Memory (PRAM), a Resistance Random Access Memory (RRAM), a Nano Floating Gate Memory (NFGM), a Polymer Random Access Memory (PoRAM), a Magnetic Random Access Memory (MRAM), a Ferroelectric Random Access Memory (FRAM), or the like.

The 3D image sensor 700 may perform the first sensing and the second sensing. The 2D image sensor 800 may perform the third sensing.

The user interface 640 may include at least one input device, such as a keypad, the buttons 643 and 645, or the touch screen 644, and/or at least one output device, such as the speaker 648 or the display device 641. The power supply 650 may supply an operating voltage to the mobile system 600.

The mobile device 600 or components of the mobile device 600 may be mounted by using various types of packages, such as Package on Package (PoP), Ball grid arrays (BGAs), Chip scale packages (CSPs), Plastic Leaded Chip Carrier (PLCC), Plastic Dual In-Line Package (PDIP), Die in Waffle Pack, Die in Wafer Form, Chip On Board (COB), Ceramic Dual In-Line Package (CERDIP), Plastic Metric Quad Flat Pack (MQFP), Thin Quad Flat-Pack (TQFP), Small Outline Integrated Circuit (SOIC), Shrink Small Outline Package (SSOP), Thin Small Outline Package (TSOP), Thin Quad Flat-Pack (TQFP), System In Package (SIP), Multi Chip Package (MCP), Wafer-level Fabricated Package (WFP), Wafer-Level Processed Stack Package (WSP), or the like.

According to an exemplary embodiment of the present inventive concept, the DDI may reduce power consumption by cutting off interfacing with the application processor in a self clock display mode because the DDI calculates for itself the time to be displayed based on the current time and the time offset corresponding to a difference between a real time and an internal clock signal, and displays the time to be displayed in a display panel in the self clock display mode.

The present inventive concept may be applied to a mobile phone, a smart phone, a PDA, and a PMP.

The foregoing is illustrative of exemplary embodiments, and the present inventive concept should not be construed as limited the exemplary embodiments thereof. Although a few exemplary embodiments have been described, those skilled in the art will readily appreciate that many modifications are possible in the exemplary embodiments without materially departing from the spirit and scopes of the present inventive concept. Accordingly, all such modifications are intended to be included within the scope of the present inventive concept as defined in the claims.

What is claimed is:

1. A display device comprising:

a display driver integrated circuit (DDI) configured to provide an internal synchronization signal based on an internal clock signal as a synchronization signal;

a display panel; and an application processor configured to calculate a time offset corresponding to a difference between a real time and the internal synchronization signal, and to provide the time offset to the DDI, wherein the DDI is configured to calculate a time to be displayed based on the time offset and a current time provided from the application processor, and to display the time to be displayed in the display panel in a self clock display mode during which the application processor does not transmit an image signal.

2. The display device of claim 1, wherein the DDI comprises:

an oscillator configured to generate the internal clock signal;

an internal synchronization signal generator configured to generate an internal horizontal synchronization signal and an internal vertical synchronization signal based on the internal clock signal; and a timer logic circuit configured to generate digital time information corresponding to the time to be displayed based on the time offset, the internal clock signal, and the current time.

3. The display device of claim 2, wherein the DDI further includes an interface configured to provide the application processor with one of the internal horizontal synchronization signal and the internal vertical synchronization signal as the synchronization signal.

4. The display device of claim 2, wherein the timer logic circuit includes:

a register configured to store the time offset; and an internal timer configured to output the digital time information based on the internal clock signal, the current time, and the time offset stored in the register.

5. The display device of claim 4, wherein the internal timer includes:

a counter configured to count the internal clock signal, and to output a counting value; and a time adjuster configured to receive the current time and the time offset, to adjust the current time based on the counting value and the time offset, and to provide the digital time information.

6. The display device of claim 4, wherein the DDI further includes:

a symbol memory configured to store a plurality of timing symbols that are used for displaying the time to be displayed; and a control logic circuit configured to control the symbol memory such that, among the plurality of timing symbols, timing symbols associated with the time to be displayed are output.

7. The display device of claim 1, wherein the DDI further includes a selection circuit configured to select one of the image signal and the time to be displayed, and to provide the selected one of the image signal or the time to be displayed to a timing controller in response to a mode change signal, and wherein the mode change signal is one of the self clock display mode and a video mode, and the image signal provided from the application processor is displayed in the vide mode.

8. The display device of claim 1, wherein the application processor includes:

an offset calculator configured to calculate the real time and the time offset based on the synchronization signal; and a real time generator configured to generate the real time.

9. The display device of claim 1, wherein the application processor is connected to the DDI through a high speed serial interface (HSSI), and wherein the application processor is configured to enter into a sleep mode in the self clock display mode.

10. The display device of claim 1, wherein the time to be displayed is an actual clock time in ante meridiem or post meridiem.

11. A display device comprising:

an application processor configured to provide a current time indicating a real time in response to an interrupt signal;

a display panel; and a display driver integrated circuit (DDI) configured to provide an internal synchronization signal based on an internal clock signal, to adjust a period of the interrupt signal that is provided to the application processor based on time offsets, to calculate a time to be displayed based on the current time, and to display the time to be displayed in the display panel, wherein each of the time offsets is calculated based on the current time and the internal synchronization signal.

12. The display device of claim 11, wherein the DDI comprises:

an oscillator configured to generate the internal clock signal;

an internal synchronization signal generator configured to generate an internal horizontal synchronization signal and an internal vertical synchronization signal based on the internal clock signal; and a timer logic circuit configured to generate digital time information corresponding to the time to be displayed based on the internal synchronization signal, the internal clock signal, and the current time, and wherein the internal synchronization signal is one of the internal horizontal synchronization signal and the internal vertical synchronization signal.

13. The display device of claim 12, wherein the timer logic circuit includes:

a register configured to store the time offsets;

a comparator configured to calculate a difference between two consecutive time offsets among the time offsets, and to output a digital code corresponding to the difference between the two consecutive time offsets; and an interrupt signal generator configured to adjust an activation period of the interrupt signal, in response to the digital code.

14. The display device of claim 13, wherein the interrupt signal generator is configured to increase the activation period of the interrupt signal in response to the digital code when there is no difference between the two consecutive time offsets.

15. The display device of claim 13, wherein the interrupt signal generator is configured to maintain the activation period of the interrupt signal in response to the digital code when there is a difference between the two consecutive time offsets.

16. The display device of claim 13, wherein the DDI further includes a temperature sensor configured to sense an operating temperature of the DDI, wherein the temperature sensor is configured to provide the interrupt signal generator with a temperature signal that is activated when the sensed operating temperature is out of a reference time range, and wherein the interrupt signal generator is configured to provide the interrupt signal to the application processor in response to the temperature signal.

17. The display device of claim 11, wherein the application processor is configured to enter into a sleep mode after the application processor transmits the current time to the DDI in response to the interrupt signal.

18. A mobile electronic apparatus comprising:

a mobile device; and a display device configured to operate in cooperation with the mobile device, the display device including:

an application processor including a real time generator configured to generate a real time; and a display driver integrated circuit (DDI) connected to the application processor through a high speed serial interface (HSSI), and the DDI configured to provide an internal synchronization signal based on an internal clock signal, wherein the DDI is configured to calculate a time to be displayed based on a time offset corresponding to a difference between a current time provided from the application processor and the internal synchronization signal, and to display the time to be displayed in a display panel in a self clock display mode during which the application processor does not transmit an image signal.

19. The mobile electronic apparatus of claim 18, wherein the mobile device includes a smart phone, and the display device includes a watch-typed wearable device.

20. The mobile electronic apparatus of claim 18, wherein the DDI comprises:

an oscillator configured to generate the internal clock signal;

an internal synchronization signal generator configured to generate an internal horizontal synchronization signal and an internal vertical synchronization signal based on the internal clock signal; and a timer logic circuit configured to generate digital time information corresponding to the time to be displayed based on the time offset, the internal clock signal, and the current time.

21. The mobile electronic apparatus of claim 18, wherein the DDI comprises:

an oscillator configured to generate the internal clock signal;

an internal synchronization signal generator configured to generate an internal horizontal synchronization signal and an internal vertical synchronization signal based on the internal clock signal; and a timer logic circuit configured to generate digital time information corresponding to the time to be displayed based on the internal synchronization signal, the internal clock signal, and the current time, and wherein the internal synchronization signal is one of the internal horizontal synchronization signal and the internal vertical synchronization signal.

* * * * *